US010391022B2

(12) United States Patent
Johnston

(10) Patent No.: US 10,391,022 B2
(45) **Date of Patent: *Aug. 27, 2019**

(54) LEG MUSCLE THERAPY APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 214 days.

This patent is subject to a terminal disclaimer.

(21) Appl. No.: 15/398,621

(22) Filed: Jan. 4, 2017

(65) Prior Publication Data

US 2017/0112710 A1 Apr. 27, 2017

Related U.S. Application Data

(63) Continuation of application No. 14/956,361, filed on Dec. 1, 2015, now Pat. No. 9,539,168, which is a (Continued)

(51) Int. Cl.
*A61H 7/00* (2006.01)
*A61H 15/00* (2006.01)

(52) U.S. Cl.
CPC ..... *A61H 15/0092* (2013.01); *A61H 7/003* (2013.01); *A61H 7/007* (2013.01); *A61H 2015/0042* (2013.01); *A61H 2201/0153* (2013.01); *A61H 2201/1253* (2013.01); *A61H 2201/164* (2013.01); *A61H 2201/1635* (2013.01); *A61H 2201/1647* (2013.01); *A61H 2201/1664* (2013.01); *A61H 2201/1671* (2013.01); *A61H 2201/1676* (2013.01); *A61H 2201/1692* (2013.01); *A61H 2205/10* (2013.01); *A61H 2205/106* (2013.01); *A61H 2207/00* (2013.01)

(58) Field of Classification Search
CPC ..... A61H 15/0092; A61H 2015/0064; A61H 15/00; A61H 7/003; A61H 7/007
See application file for complete search history.

(56) References Cited

U.S. PATENT DOCUMENTS 5,730,708 A * 3/1998 Spratt ..... A61H 7/003 601/118
9,301,900 B2 * 4/2016 Johnston ..... A61H 7/007
(Continued)

*Primary Examiner* — Kristen Matter

(57) ABSTRACT

A Leg Muscle Therapy Apparatus is provided which enables the user to easily and comfortably engage the various muscles of the leg, providing the leg muscles with a therapeutic message which helps to loosen and relieve sore or damages muscles. The apparatus may also be used to assist in the removal of cellulite from areas of the leg. The apparatus is basically comprised of a frame structure means, a user engagement means, a coupling means, and an optional resistance means. The frame structure means has at least two main support members coupled together in such a manner that the leg of the user may be placed within, with the main support members surrounding a significant portion of the leg. The main support members are adjustably coupled together by the coupling means such that they may alternatively move away and towards one another, as the various leg muscles of the user are being engaged by the user engagement means. The optional resistance means may be used to provide motion resistance.

13 Claims, 18 Drawing Sheets

Related U.S. Application Data continuation-in-part of application No. 13/507,836, filed on Aug. 1, 2012, now Pat. No. 9,301,900.

(56) References Cited

U.S. PATENT DOCUMENTS

| | | | | |
|---|---|---|---|---|
| 9,539,168 | B2 * | 1/2017 | Johnston | A61H 7/007 |
| 2002/0019601 | A1 * | 2/2002 | Wada | A61H 15/0078 601/131 |
| 2013/0289454 | A1 * | 10/2013 | Wang | A61H 11/00 601/132 |
| 2014/0228722 | A1 * | 8/2014 | Nelson | A61H 15/0092 601/125 |

* cited by examiner

LEG MUSCLE THERAPY APPARATUS

BACKGROUND OF THE INVENTION

This invention relates to a Leg Muscle Therapy Apparatus which has a frame structure composed of at least two support structures, each having a generally arc shaped inner surface, with the support structures being adjustably coupled together. Each support structure has rounded user engagement elements along the arced inner surface of the structure which may be used to engage the thigh and calf of the user, allowing the user to perform body therapy routines on these areas of the lower body. These therapy routines may be performed while the user is in any type of relaxed position by grasping the invention with their hands and moving the invention over the desired thigh or calf area of the lower body. The invention will automatically adjust itself to different thigh and calf contours, since these muscles are typically smaller at the lower ends. The ability of the apparatus to engage any area of the leg muscle with the engagement elements of the support structure, and also its ability to easily adjust itself for the various thickness and contours of the thigh and calf muscles, allows for an easy and comfortable message type therapy for those particular leg muscle groups which are sore or have been traumatized due to an accident or illness. The invention may also be used to assist in the removal of fat tissues and cellulite from any affected leg muscle area.

SUMMARY AND OBJECTS OF THE INVENTION

It is the object of this invention to provide a therapeutic apparatus which may provide the user as efficient and inexpensive means for messaging the leg muscle groups of the lower body. The main purpose of this application is to demonstrate an apparatus which performs the stated function, and to demonstrate the many options and configurations this apparatus may take on.

Briefly stated, the apparatus that forms the basis of the present invention comprises a frame structure means, a coupling means, and a user engagement means. The frame structure means may be comprised of at least two main support member, each having an arc shaped inner surface onto which the user engagement means may mount. The main support members may include a hand engagement member so that the user may easily grasp the structure with their hands. The coupling means of the apparatus couples the two main support members together so that they may easily move in a controlled manner away and towards one other as the varying contours of the leg muscles are being engaged by the user engagement means. Movement may be in either along a generally arced path or along a generally linear path, depending upon the design of the apparatus. The apparatus may also utilize a resistance means which provides resistance to the members moving apart from one another, and which may also provide a force against the leg muscles by the user engagement means.

In order to operate the apparatus, the user will grasp the main support members with their hand, place their leg within the opening created by the main support members, and move the Leg Muscle Therapy Apparatus along the thigh and/or calf area of the lower body, in either a linear or circular pattern. As mentioned, the leg of the user will be placed within the apparatus, which has a ring-type form when the two main support members are coupled together. As the apparatus moves along an area of the leg, such as the thigh muscles, the main support members will begin to separate, or move opposite one another, as the apparatus moves over the larger areas of the thigh muscles. This separation may be resisted by the hands of the user, or by the optional resistance means, or both. Also, as the apparatus moves back over the smaller areas of the thigh muscles, the main support members will move back towards one another, either by the user pushing the members back together or by the force exerted on the members by the optional resistance means which pulls them back together, or both. The resistance to separation, as provided by either the hands of the user or the optional resistance means, thus allows a force to be applied to the thigh area as the apparatus moves along its various contours.

Also, other configurations may be possible which allow the apparatus to increase it flexibility. The apparatus may be designed to utilize more than two main support members coupled together to increase the amount of leg muscles area being engaged at any given time. Also, additional resistance components may be added to the apparatus to easily vary the amount of resistance to separation, and thus the amount of force provided by the apparatus against the leg muscle of the user. Also, having a user engagement means which is a completely separate component from the main support member may be preferred.

The overall basic design of the apparatus is such that the user engagement means may be a component which mounts upon the arced inner surface of the main support member and provides the main contact with the leg muscle of the user. The user engagement means may be a series of user engaging elements which are rounded, nodule-like elements which extend outward from the arced inner surface of the main support members. They may be spaced apart from each other so that maximum contact is provided upon the leg muscle. The user engaging elements may be a molded part of the main support member, individually attached components, or part of a user engagement means which is separately attached. The user engaging elements may also be a type of roller bearing elements which roll as they engage the leg muscle of the user. As mentioned previously, the force exerted on the leg muscles by the user engaging elements may be applied by the hands of the user, by an optional resistance component, or both. The user engaging elements will therefore apply a firm force against the leg muscles, and provide a deep therapeutic message. The arc design of the inner surface of the main support members allows numerous engaging elements to simultaneously be in contact with the leg muscles, allowing for a maximum therapeutic effect. The arced inner surface of the main support member also allows the apparatus to be easily moved by the user along the leg muscles not only in a forward and backward linear motion, but also in a circular motion around the leg muscle, either individually or simultaneously. In addition to providing a type of therapeutic exercise of the thigh and calf muscles as described, the apparatus will also assist with the removal of fat tissues and cellulite from affected areas of the leg by breaking them down and allowing the body to naturally dissolve the fat tissue.

BRIEF DESCRIPTION OF THE DRAWINGS

FIG. 3B is a side view of the coupling means of the Leg Muscle Therapy Apparatus.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1A:
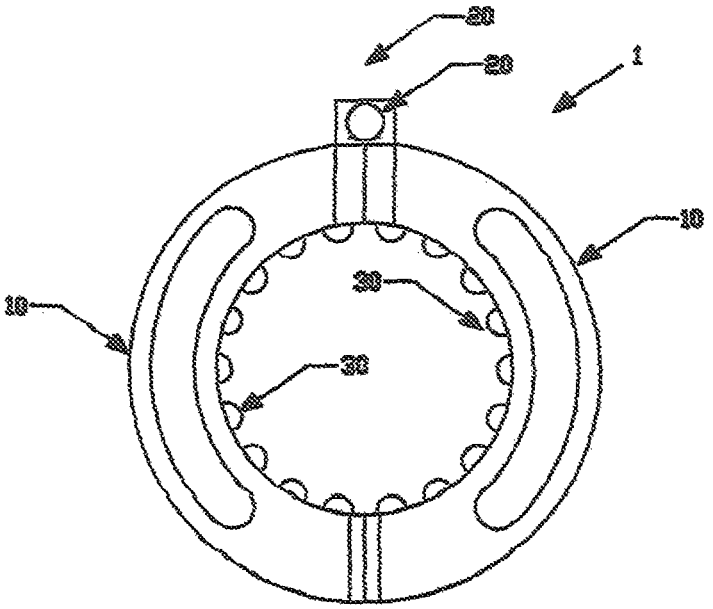
FIG. 1A is a front view of the Leg Muscle Therapy Apparatus.
Figure 1B:
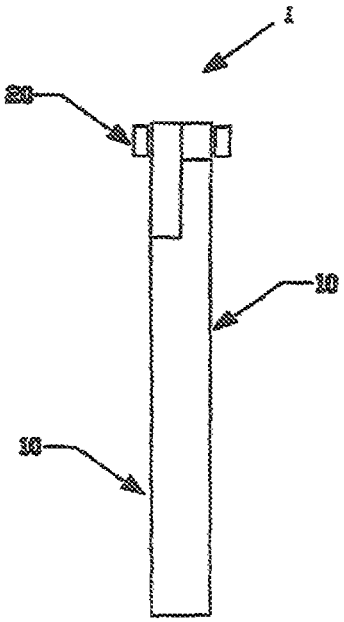
FIG. 1B is a side view of the Leg Muscle Therapy Apparatus.
Figure 1C:
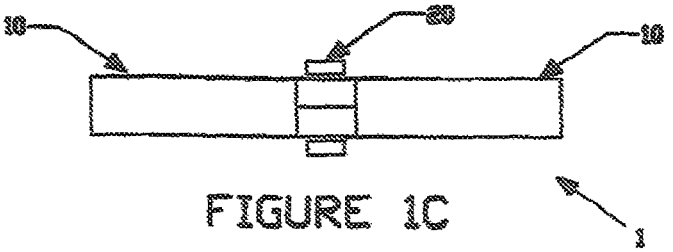
FIG. 1C is a top view of the Leg Muscle Therapy Apparatus.
Figure 2A:
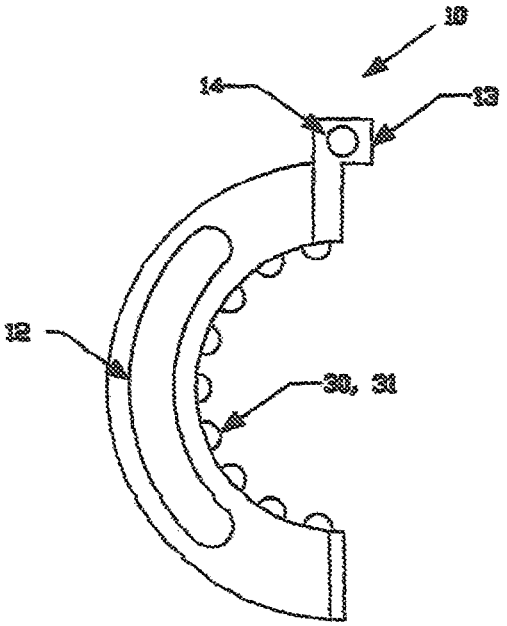
FIG. 2A is a front view of a main support member of the frame structure means and the user engagement means of the Leg Muscle Therapy Apparatus.
Figure 2B:
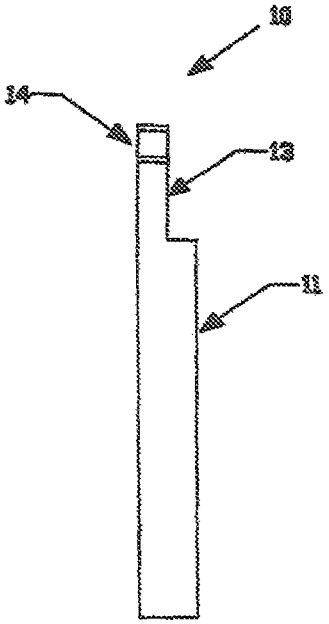
FIG. 2B is a side view of a main support member of the frame structure means and the user engagement means of the Leg Muscle Therapy Apparatus.
Figure 2C:
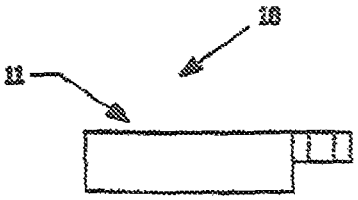
FIG. 2C is a top view of a main support member of the frame structure means of the Leg Muscle Therapy Apparatus.

As best can be seen by references to the drawings, and in particular to FIGS. 1A-1C, the Leg Muscle Therapy Apparatus that forms the basis of the present invention is designated generally by the reference numeral 1, and includes a frame structure means 10, coupling means 20, and user engagement means 30. The frame structure means 10 may be structured in such a manner that it has a circular form into which the leg of the user may be placed. The components of the frame structure means 10 and the coupling means 20 are mounted together in such a manner that the apparatus may automatically adjust to different leg muscles sizes and contours.

As may be seen in FIGS. 2A-2D, the frame structure means 10 may comprise at least two main support members 11, user handle members 12, and support coupling members 13 with coupling member openings 14. The main support member 11 may be a relatively rigid structure having an outer surface and a curved inner surface. The curved inner surface supports user engagement means 30. The user engagement means 30 may be a series of rounded nodule-like user engagement elements 31 which extend outward from the inner surface of the main support member 11. They may be a molded part of the main support member 11, or they may be individually attached in some typical manner such as a screw. User handle member 12 may be an open area extending through main support member 11 which allows the user to more easily grasp and hold the main support member 11 with their hand. As further shown, main support member 11 has support coupling members 13 mounted at one end, with the support coupling member 13 having a coupling member opening 14. Coupling member opening 14 is an elongated shaft-like opening extending from one side of the main support member 11 to its opposite side.

In the figures, user engagement means 30 has user engaging elements 31 which are rigidly mounted to the inner surface of main support member 11. As mentioned, they may be individually mounted elements or molded to the inner surface of the main support member. They could also be part of a separate curved user engagement means which rigidly mounts to the inner surface of main support member 11 through a mounting element such as a screw. The figures also show a handle member 12 which extends as a curved opening through the main support member 11, but the user handle member 12 could also be just an indented space extending a small distance into the main support member 11. The handle member 12 could also be a separate component mounted at some location on main support member 11. It is also possible for the user to just grasp each main support member 11 with their respective hand so that the members themselves function as a type of handle member, provided the members are sized to easily grasp. Many variations of this apparatus are thus possible.

Figure 3A:
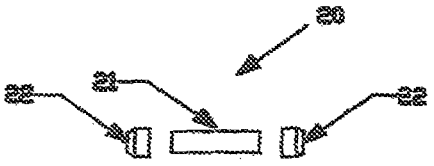
FIG. 3A is a front view of the coupling means of the Leg Muscle Therapy Apparatus.
Figure 3C:
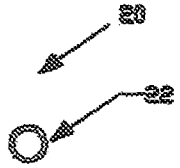
FIG. 3C is a top view of the coupling means of the Leg Muscle Therapy Apparatus.
Figure 3C:
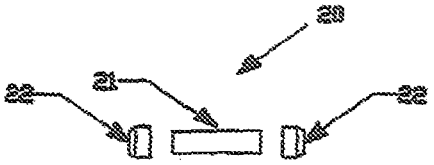
Figure 3D:
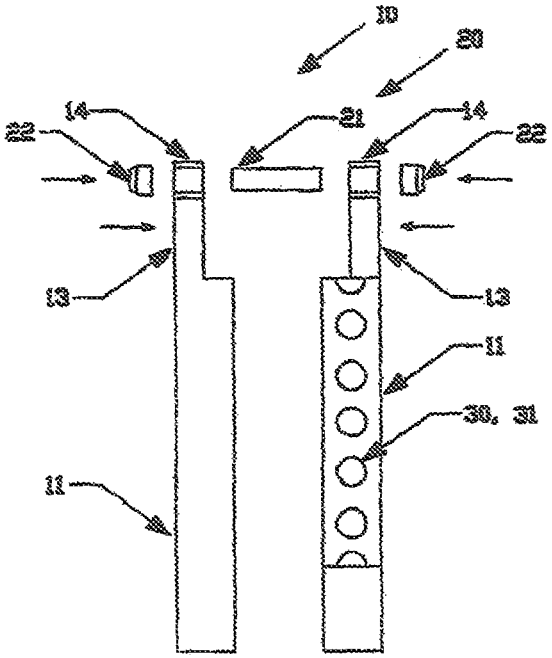
FIG. 3D is a side view of the Leg Muscle Therapy Apparatus demonstrating how the coupling means joins together the main support members of the frame structure means.

As may be seen in FIGS. 3A-3D, coupling means 20 comprises a generally elongated shaft member 21 with stop members 22 mounted on each end. Stop members 22 are used to prohibit the main support members 11 from separating completely from on another as they move. The stop members 22 may be a type of locking cap which slide onto shaft member 21 and lock in place. Shaft member 21 and stop members 22 may also be a type of bolt and screw assembly. FIG. 3D demonstrates how the coupling means 20 and frame structure means 10 mount together so that the main support members 11 may pivot about shaft member 21.

Figure 4A:
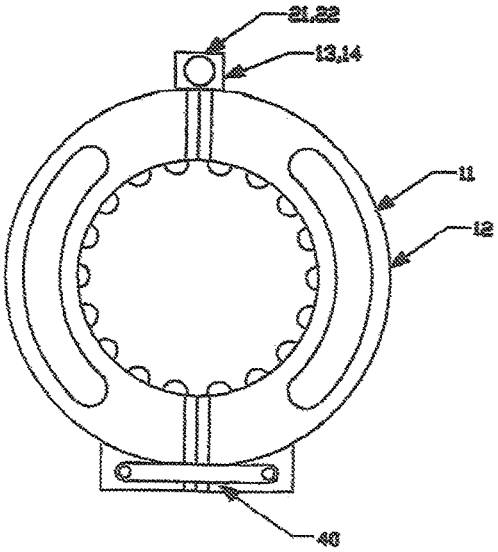
FIGS. 4A and 4B are front views of the Leg Muscle Therapy Apparatus demonstrating the automatic adjusting feature of the apparatus which occurs as the apparatus is moved along the various contours of the leg muscles, along with the optional resistance means.
Figure 4B:
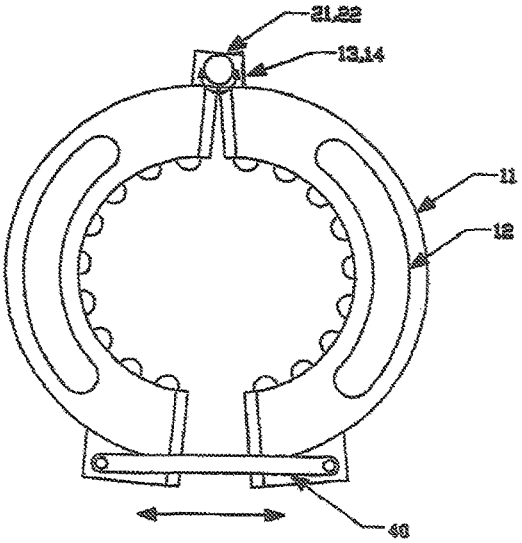

FIGS. 4A and 4B demonstrate the basic configuration and operation of the apparatus. As shown, the support coupling members 13 of main support members 11 are coupled together by shaft members 21 and form a generally loop shaped structure. Shaft members 21 extend through the coupling member openings 14 of each support coupling members 13. As mentioned, stop members 22 are mounted on each end of shaft member 21 to limit the amount of separation possible between the two main support members 11. The apparatus may include an optional resistance component 40, such as a resistance band.

Figure 4C:
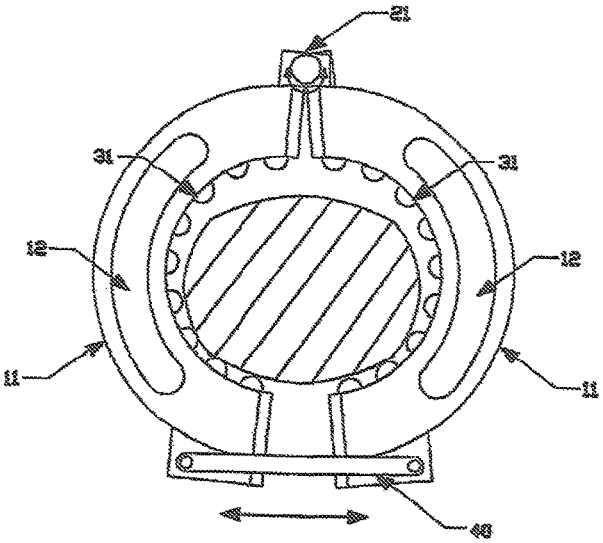
FIG. 4C is a side view of the Leg Muscle Therapy Apparatus demonstrating a cross sectional area of a user leg located within the apparatus, and demonstrating how the user engagement means of the apparatus engages the leg of the user while moving along its contour, and also how the main support members reacts accordingly.
Figure 4D:
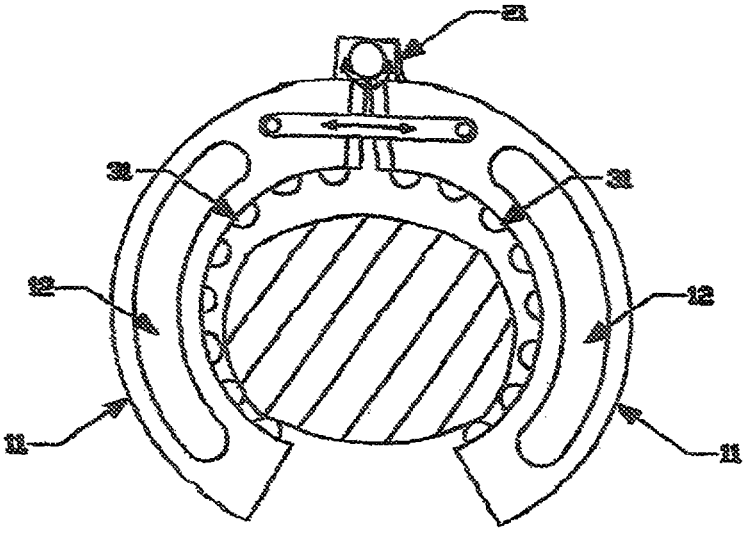
FIG. 4D is a side view of the muscle therapy apparatus demonstrating a cross sectional area of a user leg located within the apparatus, and demonstrating how the user engagement means of the apparatus engages the leg of the user while moving along its contour, and also how the main support members reacts accordingly, with a resistance means located at the top, and the main support members being shorter in length.

As may be further seen, the user may operate the apparatus by grasping the apparatus with their hands using the user handle members 12, while placing their leg within the open loop area created by the coupling of the two main support members 11. Shown in the FIG. 4C is a typical cross section of a human leg. Using the handle members 12, the user may grasp the apparatus and move it over the desired leg muscle, with the leg muscles being engaged by the user engaging members 31 of the user engagement means. As the apparatus moves along the respective leg muscle group, the user engaging members 31 will make contact with the respective muscles, providing a type of therapeutic message. As also shown, as the apparatus moves along the contour of the thigh or calf muscles, the main support structures 11 of the apparatus will pivot apart from one another as larger areas of the leg muscles are being engaged. They will pivot closer to one another as smaller portions of the leg muscles are being engaged. While moving the body therapy apparatus along the thigh or calf muscles of the leg, the user may also simultaneously rotate the apparatus in a circular pattern around the leg to provide an even better therapeutic action. For a smaller area that may need a heavy message, the user may want to rotate the apparatus in a back and forth circular motion only over that area of the leg needing the heavier message. This ability to engage the leg muscle in a linear or circular motion, either individually or simultaneously, makes the apparatus extremely flexible. FIG. 4D is a side view of the muscle therapy apparatus demonstrating a resistance means located at the top, and the main support members being shorter in length. This should allow the apparatus to more easily be placed upon the leg.

As shown, the main support members 11 are guided as they pivot away and towards one another by shaft member 21. Optional resistance component 40 may be mounted at either end of main support member 11, and may be utilized to provide a resistance to the pivoting motion of main support members 11, while also pushing the main support members 11 back towards one another. When the resistance component 40 utilizes a conventional resistant band, different resistant band with different strengths may be used to provide different amount of resistance. These resistance bands 40 may be convention resistance bands found and used in various fitness equipment and may mount to main support members 11 through a typical securing means such as a pin or bolt 41. Multiple resistance bands 40 may be utilized which mount to the main support members 11 at the top and bottom, and on both the front and back sides. When the resistance component 40 is not utilized, the resistance to separation and the pushing motion of the members back together may be accomplished manually by the hands of the user.

It is also possible to disassemble the leg apparatus so that the individual main support structures 11 are utilized separate from one another. The user may grasp a single main support member 11, either one at a time or one in each hand, and perform a therapy routine on parts of the body other than the leg muscles. For example, if the user is suffering from a sore arm bicep muscle, the user may grasp one of the main support members 11 with one hand, and move the user engaging elements 31 along the bleep muscle, in either a linear motion, circular motion, or both. This routine may be performed also on other parts of the body, such as the stomach, hips, or buttocks. Using an individual main support member 11 may also be performed on the leg muscles, but would not provide as much therapeutic action as the members would when coupled together.

Figure 5A:
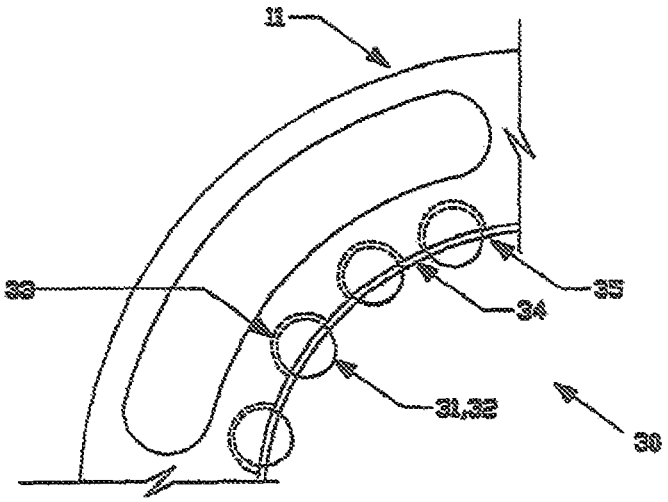
FIG. 5A is a front view of the Leg Muscle Therapy Apparatus having roller bearings as user engagement elements of the user engagement means for making movement of the body therapy apparatus smoother.

FIG. 5A demonstrates the Leg Muscle Therapy Apparatus using conventional roller bearings 32 as user engaging elements 31. Roller bearings 32 may be mounted within curved openings 33, which are semi-spherical in shape and have a larger diameter than do the roller bearings 32. This is to allow the roller bearings 32 to rotate within in any direction. The roller bearings 32 may be held in place by inner surface support 34, which may have surface openings 35 which are smaller in diameter than the roller bearings 32. The inner surface support 34 may be securely mounted to the arced inner surface of the main support member 11 through some common securing means, such as a screw, with the surface openings 35 of the inner surface support 34 being place over the roller bearings 32. This allows roller bearings 32 to rotate, but keeps them from exiting out of curved openings 33. In this instance, the user engagement means 30 is comprised of roller bearings 32, curved openings 33, inner surface support 34, and surface openings 35.

Figure 5B:
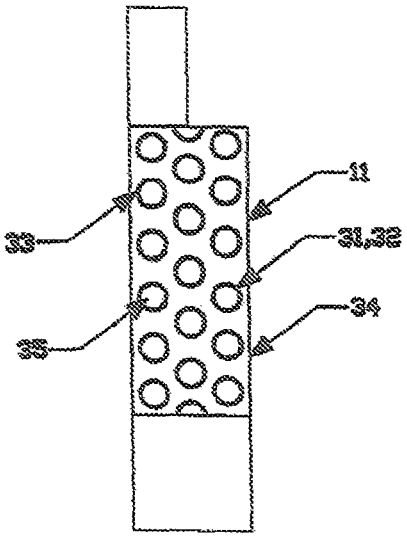
FIG. 5B is a side view of the inner surface of the Leg Muscle Therapy Apparatus demonstrating multiple row series of user engagement elements which may allow for greater contact with the leg muscle and thus a greater therapeutic message

FIG. 5B demonstrates the Leg Muscle Therapy Apparatus utilizing multiple rows of user engaging elements 31 mounted to main support member 11, instead of only a single row. Multiple rows should allow for a better therapy message, since multiple user engaging elements 31 will move over the same area. It may also prove better to have each row staggered from the one next to it, so that more contact is made with the muscles. The figures show three rows of user engaging members 31, but many versions of the apparatus may be created having four, five, six, or even more rows, depending on what works best for the individual user. It may be possible to connect two or more apparatuses together, so that the number of rows in contact with the user muscles may be selectively varied. As mentioned previously, the user engaging elements 31 may be a molded part of main support member 11, may be individually attached to main support member, or may be part of a separately attached user engagement means. The best configuration, which is that shown, may prove to be a series of rows of roller hearings 32 mounted into curved openings 33 and held in place by inner surface support 34 having surface openings 35.

Figure 6A:
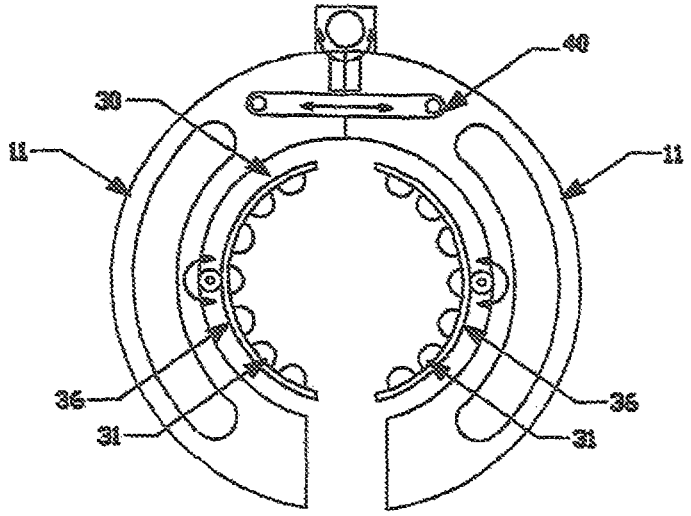
FIG. 6A is a front view of the Leg Muscle Therapy Apparatus having user engagement means which are separate components pivotally mounted to the inner surface of the main support members.
Figure 6B:
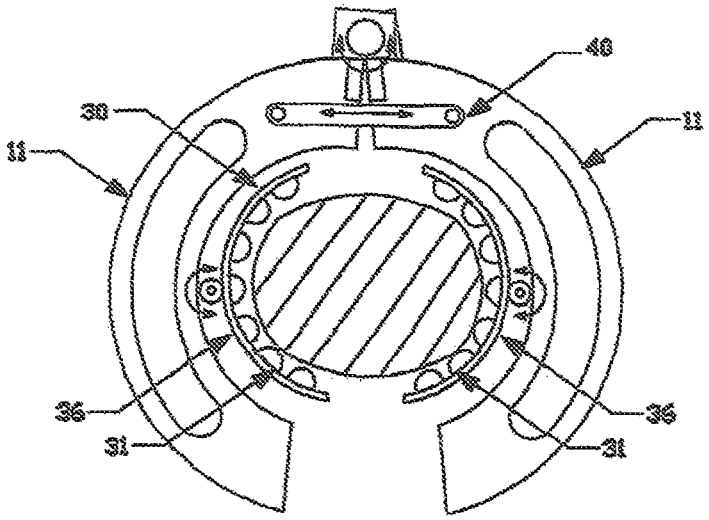
FIG. 6B is a front view of the Leg Muscle Therapy Apparatus having user engagement means which are separate components pivotally mounted to the inner surface of the main support members, and also demonstrating a cross sectional area a user leg located within the apparatus, and demonstrating how the user engagement means and main support members of the apparatus react as the user engagement means engages the leg of the user while moving along its contour.

FIGS. 6A and 6B demonstrate a Leg Muscle Therapy Apparatus having the user engaging elements 31 incorporated into a user engagement means 30 which is a completely separate component from the main support member 11. The user engaging members 31 may mount upon or may be part of an engagement support structure 36, which may be pivotally mounted at its approximate center to the inner surface of main support member 11. The engagement support structure 36 may be an arced structure having an outer and inner arced surface. As shown, the outer arc surface may be pivotally mounted at its proximate center to the arced inner surface of main support member 11, while the user engaging members 31 may mount upon the inner arced surface of engagement support structure 36. The engagement support structure 36 may also be constructed with curved openings so that user engaging members 31 may be roller bearings, as has been discussed previously. As also shown, an alternate configuration may have the resistance band 40 located near the coupling means 20, instead of being located on the opposite end of the main support members. This configuration will allow the user to position the apparatus over the leg muscles, instead of the leg muscles having to be placed within. FIG. 6B shows a cross sectional area of a user leg placed with the apparatus, and demonstrates how the user engagement means 30 reacts when it engages the leg of the user.

Figure 6C:
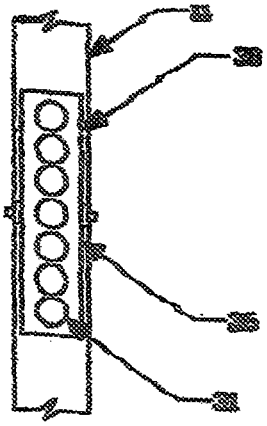
FIG. 6C is a side view of the user engagement means of the muscle therapy apparatus which is pivotally mounted to the inner surface of the main support members.
Figure 6D:
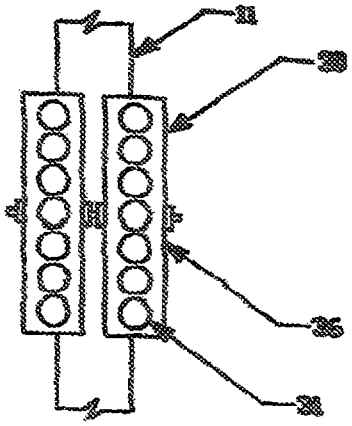
FIG. 6D is a side view of the user engagement means of the muscle therapy apparatus, showing two user engagement means pivotally mounted to the inner surface of the main support members with, each mounted so that they may pivot independent of one another.

FIGS. 6C and 6D show side views of one type of user engagement means 30 for the Leg Muscle Therapy Apparatus. In this type, there is at least one row of user engaging members 31 mounted to the engagement support structure 36. As may be seen, it is possible to have more than one, in this case, two engagement support structures 36 pivotally mounted to the inner surface of main support member 11 such that they pivot independent of one another. This could prove useful for not only engaging a larger area of the leg of the user, but also allow better adjustment to the varying contours of the leg of the user. Having more than one row of user engaging members 31 may also prove beneficial in use with the multiple engagement support structures 36.

Figure 7A:
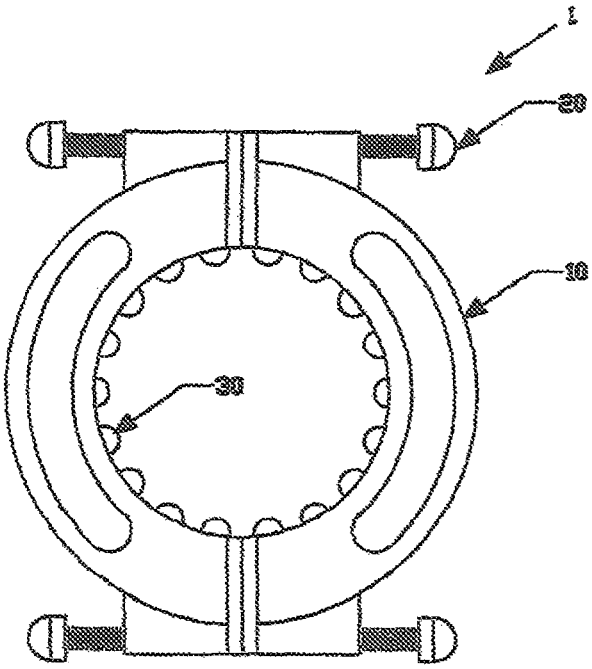
FIG. 7A is a front view of a second version of the Leg Muscle Therapy Apparatus.
Figure 7B:
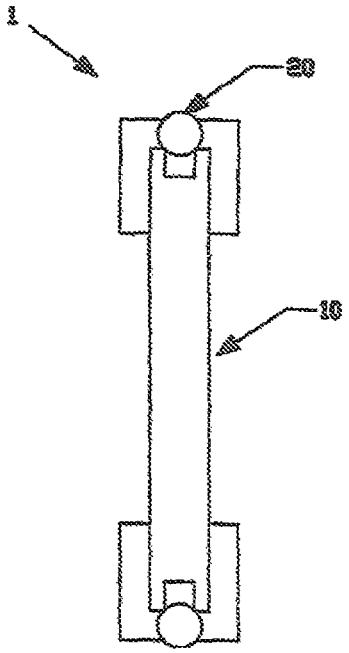
FIG. 7B is a side view of a second version of the Leg Muscle Therapy Apparatus.
Figure 7C:
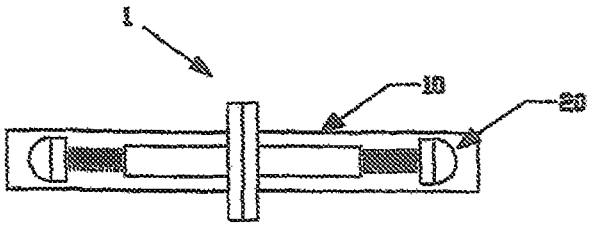
FIG. 7C is a top view of a second version of the Leg Muscle Therapy Apparatus.
Figure 8D:
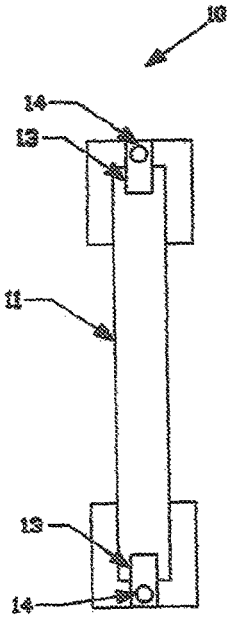
FIG. 8D is a side view of the outer surface of a main support member of the frame structure means, for the second version of the Leg Muscle Therapy Apparatus.
Figure 8A:
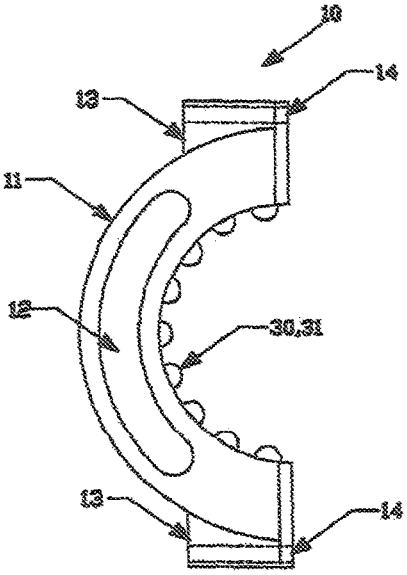
FIG. 8A is a front view of a main support member of the frame structure means, along with the user engagement means, both for the second version of the Leg Muscle Therapy Apparatus.
Figure 8B:
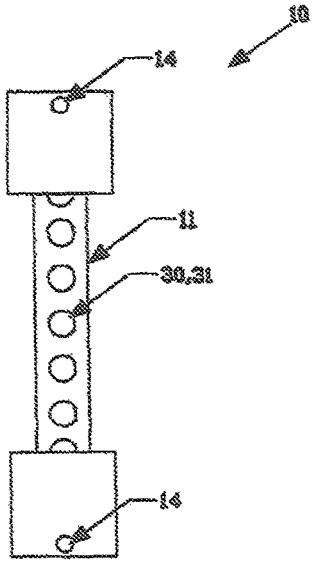
FIG. 8B is a side view of the inner surface of a main support member of the frame structure means along with the user engagement means, both for the second version of the Leg Muscle Therapy Apparatus.
Figure 8C:
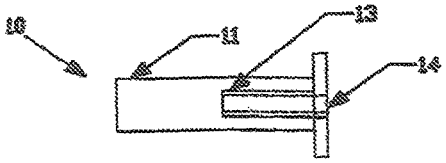
FIG. 8C is a top view of a main support member of the frame structure means, both for the second version of the Leg Muscle Therapy Apparatus.
Figure 9A:
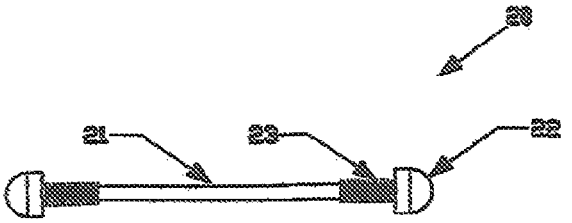
FIG. 9A is a front view of the coupling means for the second version of the Leg Muscle Therapy Apparatus.
Figure 9B:
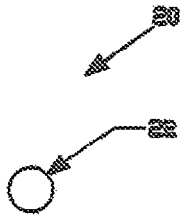
FIG. 9B is a side view of the coupling means for the second version of the Leg Muscle Therapy Apparatus.
Figure 9C:
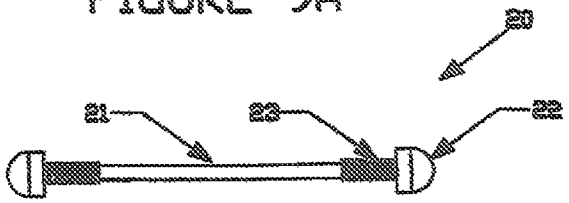
FIG. 9C is a top view of the coupling means for the second version of the Leg Muscle Therapy Apparatus.
Figure 9D:
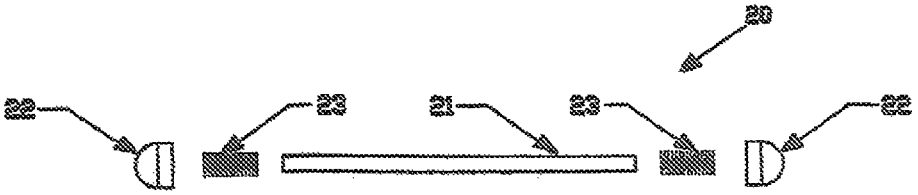
FIG. 9D is a side view of the coupling means for the second version of the Leg Muscle Therapy Apparatus, demonstrating the various components of the coupling means.

A second version of the Leg Muscle Therapy Apparatus 1 may be seen in FIGS. 7A-7C. As with the original version, the Leg Muscle Therapy Apparatus is designated generally by the reference numeral 1, and includes a frame structure means 10, coupling means 20, and user engagement means 30. The frame structure means 10 may be structured in such a manner that it has a circular form into which the leg of the user may be placed. The components of the frame structure means 10 and the coupling means 20 are mounted together in such a manner that the apparatus may automatically adjust to different leg muscles sizes.

As may be seen in FIGS. 8A-8D, the frame structure means 10 may again comprise at least two main support members 11, user handle members 12, and support coupling members 13 with coupling member openings 14. The main support member 11 may be a relatively rigid structure having an outer surface and a curved inner surface. The curved inner surface supports user engagement means 30. The user engagement means 30 may be rounded nodule-like user engagement elements 31 which extend outward from the inner surface of the main support member 11. They may be a molded part of the main support member 11, or they may be individually attached in some typical manner such as a screw. User handle member 12 may be an open area extending through main support member 11 which allows the user to more easily grasp and hold the main support member 11 with their hand. As further shown, main support member 11 has support coupling members 13 mounted at each end, with each support coupling member 13 having a coupling member opening 14. Coupling member opening 14 is an elongated shaft-like opening extending from the inner portion of the main support member 11 to its outer portion.

As may be seen in FIGS. 9A-9D, coupling means 20 comprises a generally elongated shaft member 21 with stop members 22 mounted on each end. Coupling means 20 may also comprise optional resistance spring members 23, which are basically conventional coiled spring members located on each end of shaft member 21, and are held in place by stop members 22. Stop members 22 are used to prohibit the main support members 11 from separating completely from on another as they move, whether the optional resistance springs 23 are utilized or not. The stop members 22 may be a type of locking cap which slide onto shaft member 21 and lock in place. Shaft member 21 and stop members 22 may also be a type of bolt and screw assembly.

As with the original version, the components of the frame structure means 10, the coupling means 20, and the user engagement means 30, all function in similar manner and may also take on various configurations. The main difference in this version is that main support members 11 move away and toward one another along a linear path of motion, as opposed to an arced path of motion.

Figure 10A:
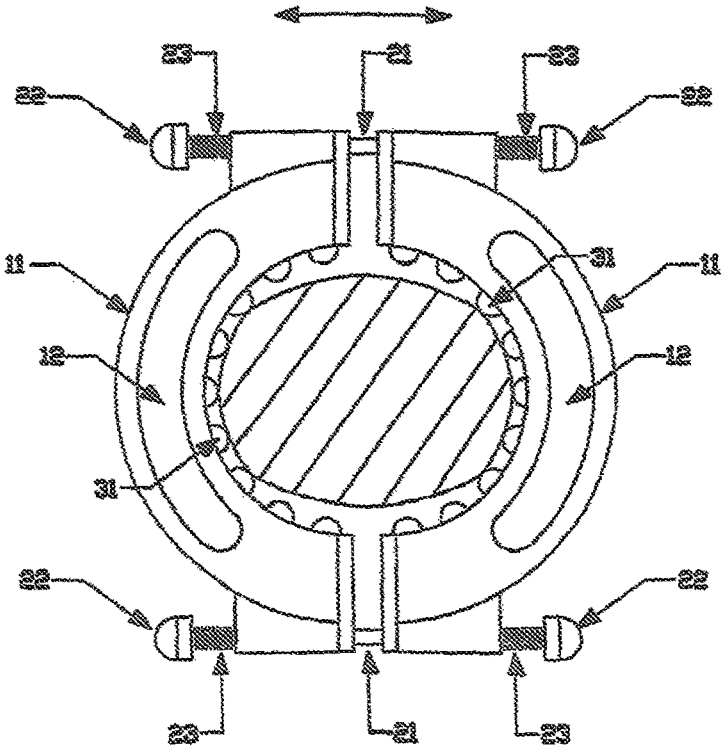
FIGS. 10A and 10B are side views of the second version of the Leg Muscle Therapy Apparatus demonstrating a cross sectional area of a user leg located within the apparatus, and demonstrating how the user engagement means of the apparatus engages the leg of the user while moving along its contour, and also how the main support members react accordingly.
Figure 10B:
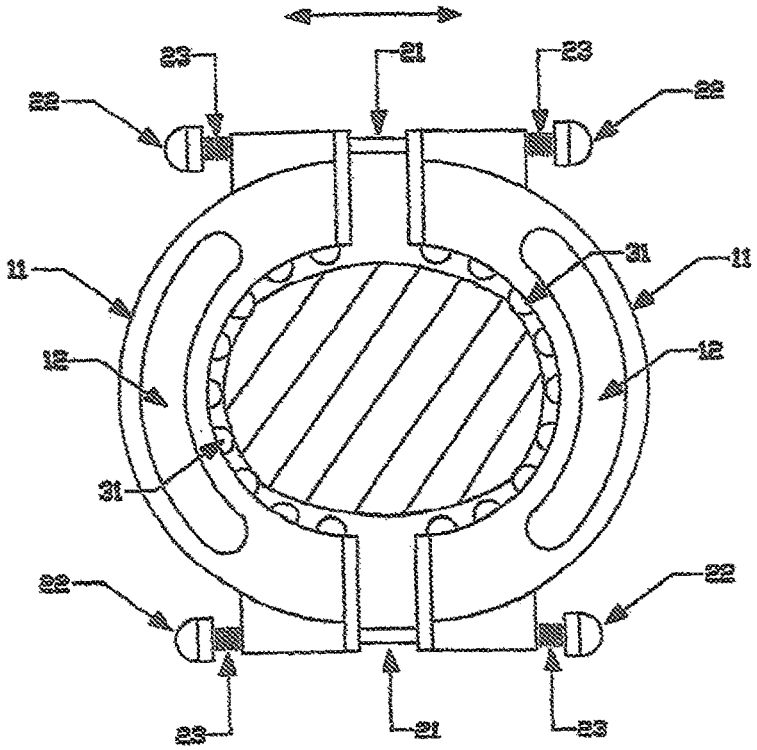

FIGS. 10A and 10B show a cross sectional area of a user leg placed within the apparatus. As may be seen, when various parts of the leg which are different in size are engaged by the user engaging members 31, the main support members will move accordingly. When a larger cross sectional area is engaged, the main support members 11 move away from one another. When a small cross sectional area is engaged, the main support members 11 move towards one another. Again, motion is along a linear path.

Figure 10C:
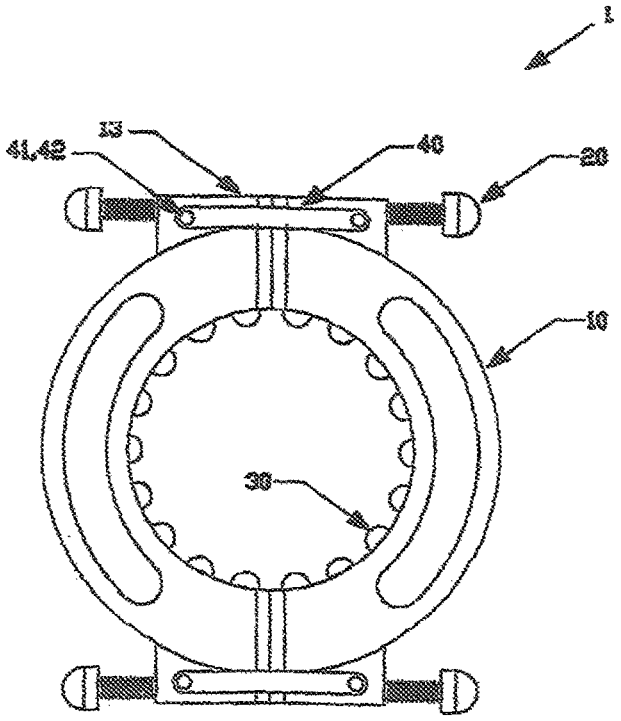
FIGS. 10C and 10D are front views of the Leg Muscle Therapy Apparatus demonstrating the automatic adjusting feature of the apparatus which occurs as the apparatus is moved along the various contours of the leg muscles, along with the optional resistance means.
Figure 10D:
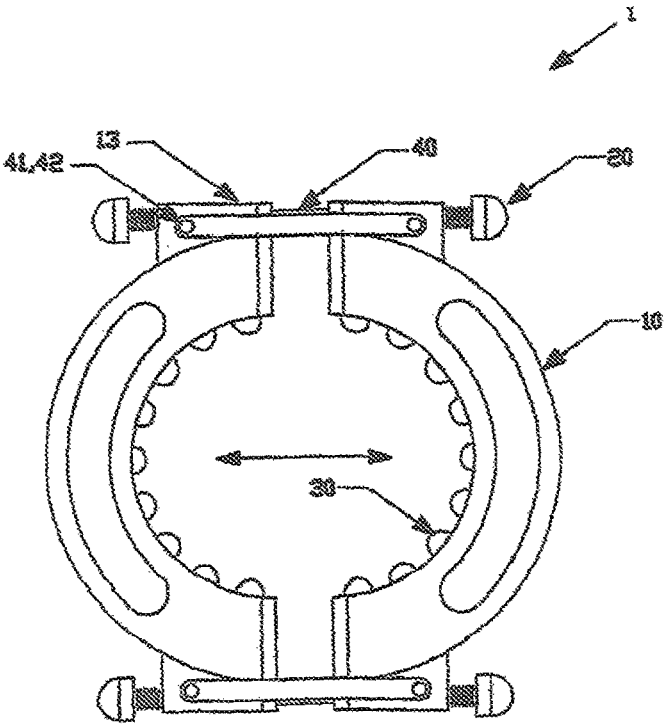

As shown in FIGS. 10C and 10D, optional resistance means 40 comprising optional resistant bands 41 may be also utilized with this version of the apparatus. As before, different resistant bands having different resistance strengths may be used to vary the amount of resistance. These resistance bands 40 may be convention resistance bands found and used in various fitness equipment and may mount to support coupling members 13 through a typical seeming means such as a pin or bolt 42. Multiple resistance bands 41 may also be utilized which mount to the support coupling members 13 at the top and bottom of each main support member, and on both the front and back sides. When the resistance component 40 is not utilized, the resistance to separation and the pushing motion of the members back together may be accomplished manually by the hands of the user.

Figure 11A:
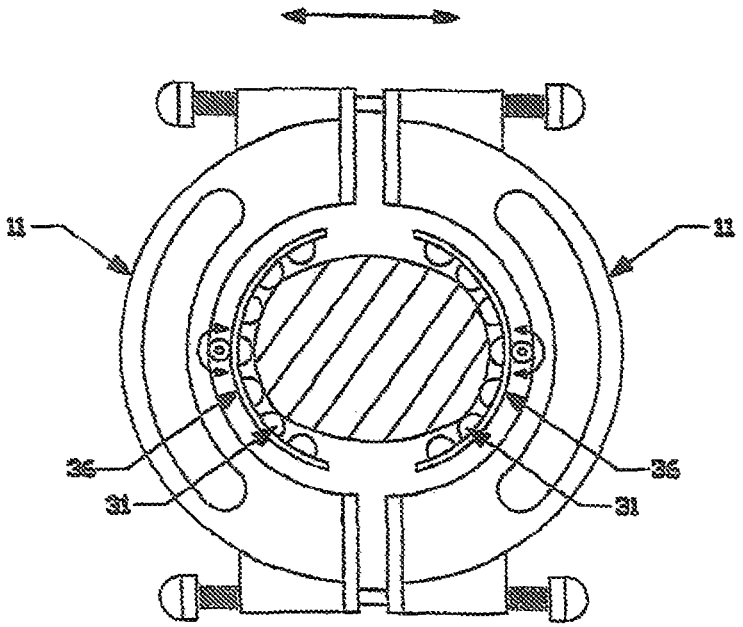
FIGS. 11A and 11B are front views of the second version of the Leg Muscle Therapy Apparatus having user engagement means which are separate components pivotally mounted to the inner surface of the main support members, and also demonstrating a cross sectional area of a user leg located within the apparatus, and demonstrating how the user engagement means and main support members of the apparatus react as the user engagement means engages the leg of the user while moving along its contour.
Figure 11B:
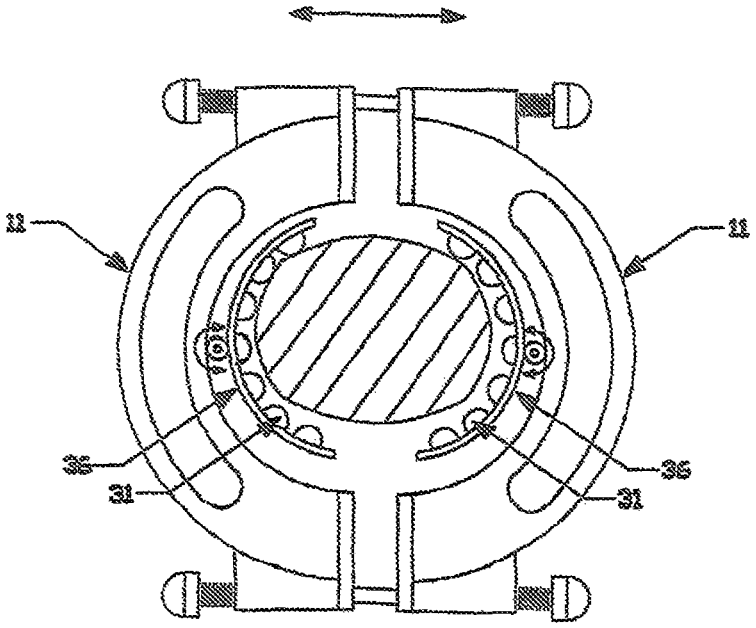

FIGS. 11A and 11B demonstrate the second version of the Leg Muscle Therapy Apparatus having the user engaging elements 31 incorporated into a user engagement means which is a completely separate component from the main support member 11. The user engaging members 31 may mount upon or may be part of an engagement support structure 36, which may be pivotally mounted at its approximate center to the inner surface of main support member 11. The engagement support structure 36 may be an arced structure having an outer and inner arced surface. As shown, the outer arc surface may be pivotally mounted at its proximate center to the the arced inner surface of main support member 11, while the user engaging members 31 may mount upon the inner arced surface of engagement support structure 36. The engagement support structure 36 may also be constructed with curved openings so that user engaging members 31 may be roller bearings, as has been discussed previously. FIGS. 11A and 11B both demonstrates a cross sectional area of a user leg which has the apparatus placed within. FIGS. 11A and 11B show a cross sectional area of a user leg placed within the apparatus, and demonstrates how the user engagement means 30 reacts when it engages the leg of the user.

In any version, having the user engaging member 31 mounted on an engagement support structure 36 which is pivotally mounted as a separate component to the main support member 11 should provide a much more flexible body therapy apparatus. As also shown, the engagement support structure 36 may pivot both towards and away from the inner surface of main support member 11. Shown in the figures is a cross section of the human leg. When the apparatus is moved along a portion of the leg of the user, the pivoting motion of the engagement support structure 36 allows the user engaging members 31 to remain in better contact with the leg muscle of the user. This concept will make the apparatus more complicated and thus more expensive, but should provide more flexible and a better therapy routine. This concept may be incorporated into any of the versions described previously. As also mentioned previously, a single main support member 11 having this pivoting engagement support structure 36 may be used to provide therapy to other parts of the body, such as the biceps of the arm, the hips, the stomach, and the buttocks.

Figure 12A:
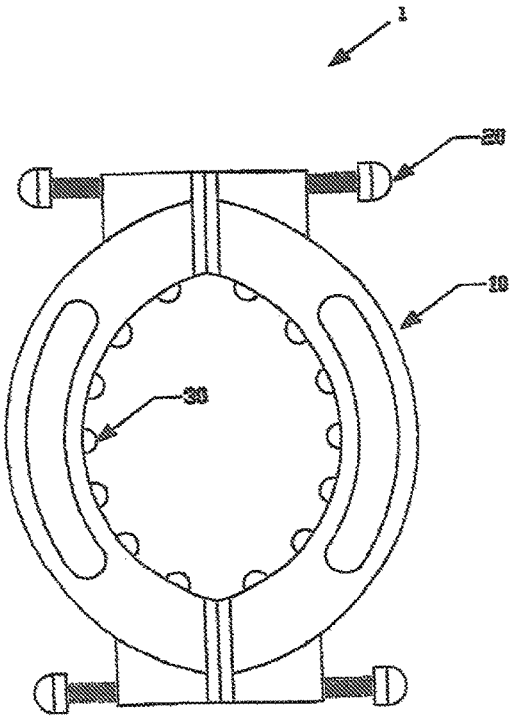
FIGS. 12A and 12B are front views of the second version of the Leg Muscle Therapy Apparatus demonstrating the main support members of the apparatus having a larger inner radius of curvature.
Figure 12B:
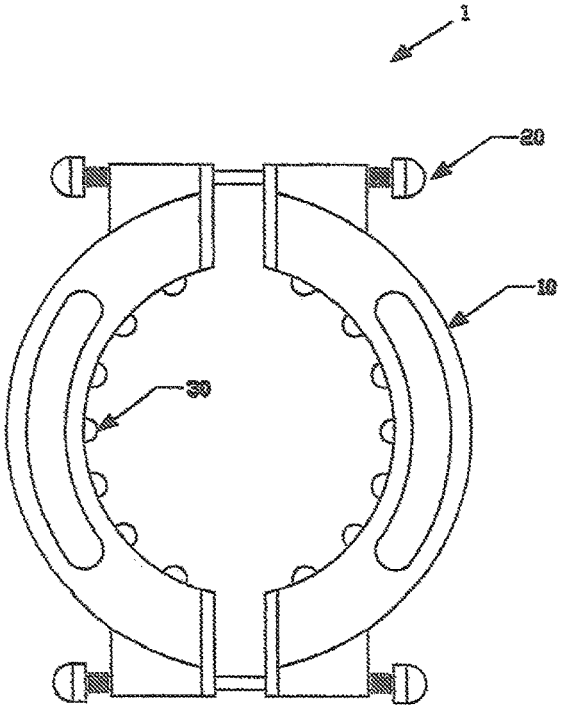

FIGS. 12A and 12B demonstrate a different construction feature for the second version of the Leg Muscle Therapy Apparatus 1. In this version, the frame structure means 10 forms a more elliptical shape when coupled together by coupling means 20, as opposed to the more circular shape shown previously. This elliptical shape may prove to provide better contact between user engagement means 30 and leg muscles which are larger in size than normal. This may prove true also for the original pivoting version, and also for the user engagement means when it is a separately attached component.

Figure 13A:
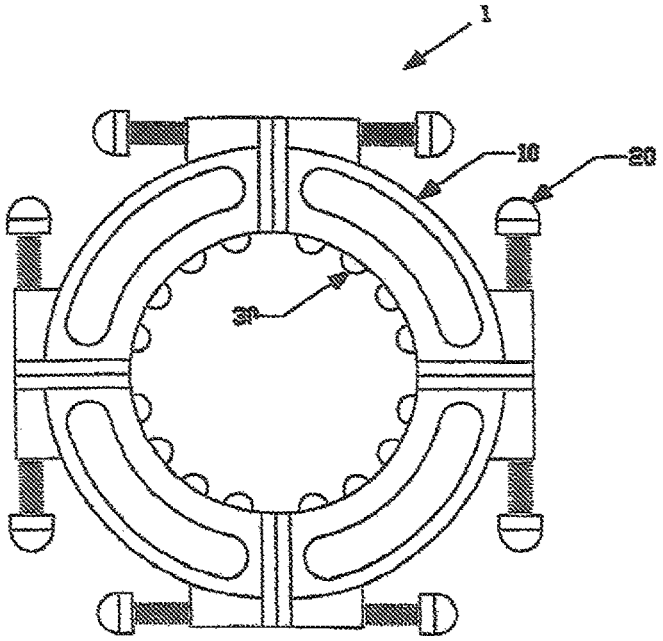
FIGS. 13A, 13B, and 13C are front views of a third version of the Leg Muscle Therapy Apparatus demonstrating an apparatus with more than two main support members, and how the main support members react as the user engagement means is moved along the leg of the user.
Figure 13B:
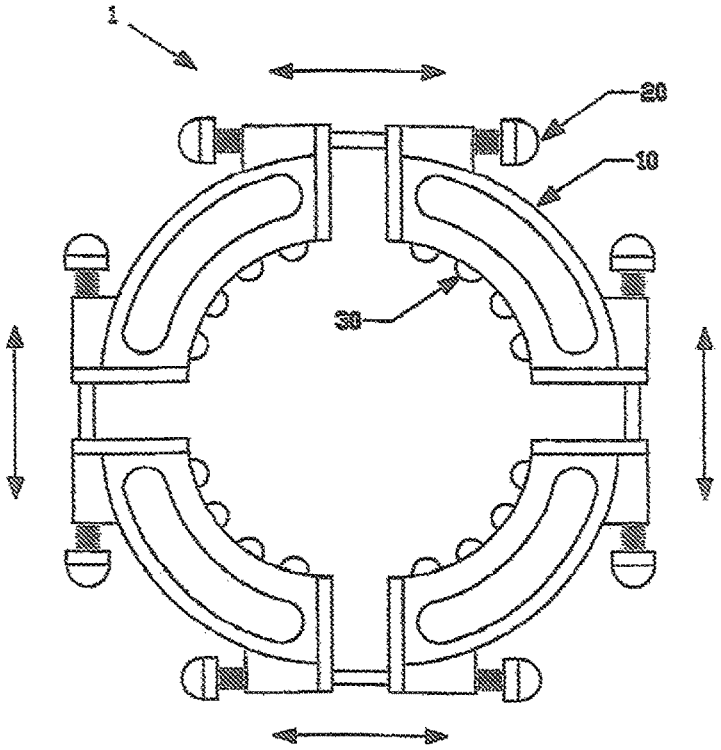
Figure 13C:
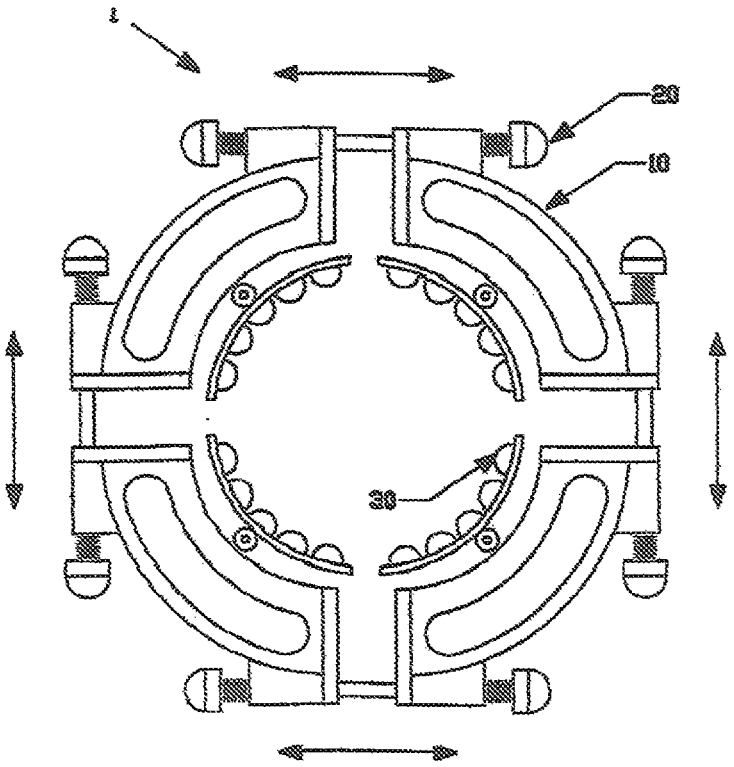

FIGS. 13A and 13B demonstrate another version of Leg Muscle Therapy Apparatus 1 having a frame structure means 10 with more than two main support members coupled together. In this instance, frame structure means 10 has four main support members coupled together by four coupling means 20. In this version, each of the main support members comprise a quarter-arc shape, with all four quarter-arc shaped main support member creating a closed circular shaped frame structure means 10 when coupled together. FIG. 13C demonstrates this version having a separately mounted user engagement means 30.

Figure 14A:
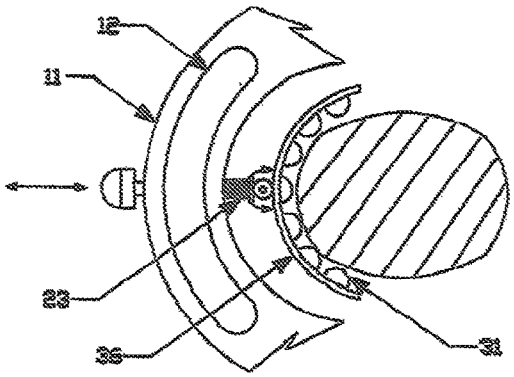
FIGS. 14A and 14B are front views of the Leg Muscle Therapy Apparatus with a main support member having a user engagement means which is both pivotally and linearly mounted as a separate component such that the user engagement means may pivot in an arced path and simultaneously move back and forth along a linear path.
Figure 14B:
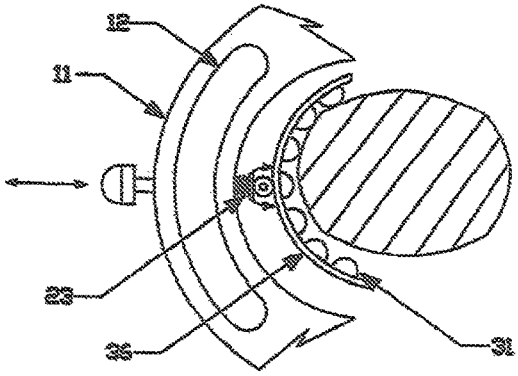

FIGS. 14A and 14B demonstrate a Leg Muscle Therapy Apparatus having an engagement support structure 36 which is both pivotally and linearly coupled to the main support member 11. The engagement support structure 36 will not only pivot towards and away from the inner surface of the main support member 11, but also move along a linear path towards and away from its inner surface. The main support member 11 thus serves as a type of guide bearing for guiding the engagement support structure 36 along a linear path of motion. In this case the handle member 12 would more than likely need to be an indented space into the main support member 11 instead of a through space.

In this version, a spring member 23 may also be used to resist the movement of the engagement support structure 36 towards the inner surface of the main support member 11. It will also push the engagement support structure back against the leg muscle of the user. Therefore a spring member or some type of resistance hand will not necessarily be used by the coupling means and the support coupling members as previously shown. Instead of two or more main support members, the main structure means may now be constructed of only one arced or circular shaped main member, since the linear movement away and towards the leg muscle of the user is now done by the engagement support member, not the support coupling member and the coupling means. The main disadvantage with this version is that resistance may no longer be applied by the hands of the user. Multiple main support members may still be utilized, but may now be rigidly connected together using a bolt and nut. However, an apparatus may still be constructed which has two or more main support members connected together using a coupling means, and also utilize a pivoting and linear moving engagement support structure. Hence the combinations and variations of the body therapy apparatus derived from this capability are numerous.

Many variations of the Leg Muscle Therapy Apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A leg muscle therapy apparatus comprising:

two main support members, each of said main support members comprising a support structure member having a first end and a second end;

a coupling member for pivotally coupling the first ends of said main support members together so that the support structure member of each of said main support members may pivotally move away and towards one another;

at least one user engagement member pivotally mounted to each of said support structure members such that said at least one user engagement member pivots toward and away from an inner surface of said support structure member, said at least one user engagement member having a curved inner surface with said at least one user engaging element mounted thereon; said at least one user engaging element having an outward surface of which is generally concave in shape;

whereby each of said main support members of said leg muscle therapy apparatus may be positioned around a leg of a user in such a manner that the user may move said main support members along the contours of the leg, in both a linear and circular motion, such that said at least one user engaging element mounted to said inner surface of each of said at least one user engagement member may engage the leg of the user, with said coupling member allowing said main support members to pivotally move away and towards one another as varying contours of the leg are being engaged, thereby providing a muscle therapy routine on the leg of the user.

2. A leg muscle therapy apparatus as claimed in claim 1, further comprising a resistance element coupled to the main support members for providing a resistance to the movement of said inner surfaces of said main support members away from one another, and for providing a force for pulling the inner surfaces of said main support members towards one another.

3. A leg muscle therapy apparatus as claimed in claim 1, said at least one user engaging element being rigidly mounted along the curved inner surface of each of said user engagement members.

4. A leg muscle therapy apparatus as claimed in claim 1, said at least one user engaging elements being at least one roller bearing rotatably mounted along the curved inner surface of each of said user engagement members.

5. A leg muscle therapy apparatus as claimed in claim 1, each user engagement member having a pivot point which is movable along a linear path towards and away from said inner surface of said support structure member upon which it is mounted; along with an engagement resistance element for resisting movement of said pivot point towards said support structure member.

6. A leg muscle therapy apparatus as claimed in claim 1, each of said main support members further having a handle member such that the user may grasp said main support member with their hand and move said main support member along the leg of the user.

7. A leg muscle therapy apparatus as claimed in claim 1 wherein the at least one user engagement member mounted to each support structure member comprises more than one user engagement member mounted to each support structure member, said user engagement members being mounted such that they pivot independent of one another.

8. A leg muscle therapy apparatus comprising:

two main support members, each of said main support members comprising a support structure member having a first end and a second end;

a coupling member for pivotally coupling the first ends of said main support members together so that the support structure member of each of said main support members may pivotally move away and towards one another;

at least one user engagement member pivotally mounted to each of said support structure member such that said at least one user engagement member pivots toward and away from an inner surface of said support structure member, said at least one user engagement member having a curved inner surface with user engaging elements mounted thereon;

a resistance element coupled to the main support members for providing a resistance to the movement of said inner surfaces of said main support members away from one another, and for providing a force for pulling the inner surfaces of said main support members towards one another;

whereby each of said main support members of said leg muscle therapy apparatus may be positioned around a leg of a user in such a manner that the user may move said main support members along the contours of the leg, in both a linear and circular motion, such that said user engaging elements mounted to said inner surface of each of said at least one user engagement member may engage the leg of the user, with said coupling member allowing said main support members to pivotally move away and towards one another as varying contours of the leg are being engaged, said resistance element providing resistance as said main support members move away from one another, thereby providing a muscle therapy routine on the leg of the user.

9. A leg muscle therapy apparatus as claimed in claim 8, said user engaging elements having a generally concave outward surface and being rigidly mounted along the curved inner surface of each of said user engagement members.

10. A leg muscle therapy apparatus as claimed in claim 8, said user engaging elements being at least one roller bearing rotatably mounted at a location along the curved inner surface of each of said user engagement members.

11. A leg muscle therapy apparatus as claimed in claim 8, each said user engagement member having a pivot point which is movable along a linear path towards and away from said inner surface of said support structure member upon which it is mounted; along with an engagement resistance member for resisting movement of said pivot point towards said support structure member.

12. A leg muscle therapy apparatus as claimed in claim 8, each of said support structure members further having a handle member such that the user may grasp said main support member with their hand and move said main support member along the leg of the user.

13. A leg muscle therapy apparatus as claimed in claim 8, wherein the at least one user engagement member mounted to each support structure member comprises more than one user engagement member mounted to each support structure member, said user engagement members being mounted such that they pivot independent of one another.

* * * * *